United States Patent [19]

Ishida

[11] 4,341,140

[45] Jul. 27, 1982

[54] AUTOMATIC PERFORMING APPARATUS

[75] Inventor: Hideaki Ishida, Hachioji, Japan

[73] Assignee: Casio Computer Co., Ltd., Tokyo, Japan

[21] Appl. No.: 227,537

[22] Filed: Jan. 22, 1981

[30] Foreign Application Priority Data

Jan. 31, 1980 [JP] Japan ..... 55/10504[U]
Jan. 31, 1980 [JP] Japan ..... 55/10505[U]
Jan. 31, 1980 [JP] Japan ..... 55/10516

[51] Int. Cl.[3] ..... G10G 7/00

[52] U.S. Cl. ..... 84/1.03; 84/477 B; 84/1.27; 84/484; 84/DIG. 12

[58] Field of Search ..... 84/1.03, 1.24, 1.27, 84/477 B, 477 R, 484, DIG. 12

[56] References Cited

U.S. PATENT DOCUMENTS 3,570,360 4/1969 Siegel ..... 84/477 R
3,578,894 10/1969 Schwartz ..... 84/1.03
4,022,097 5/1977 Strangio ..... 84/1.03
4,046,048 9/1977 Bione ..... 84/1.03
4,195,545 4/1980 Nishimoto ..... 84/1.27
4,282,681 8/1981 McCaslin ..... 84/477 B

*Primary Examiner*—J. V. Truhe
*Assistant Examiner*—Forester W. Isen
*Attorney, Agent, or Firm*—Frishauf, Holtz, Goodman and Woodward

[57] ABSTRACT

In an automatic performing apparatus, an amount of change in a motion of a moving element provided in a baton is detected, and the detected change amount is converted into an electrical signal. A tempo clock signal generator provided in the apparatus is driven by the electrical signal to produce a tempo clock signal for reading out musical data preset in a memory. A volume level of a musical tone is set by a control section on the basis of the data of a peak level of the change amount in the motion of the baton. The tone data stored in the memory is read out on the basis of the tempo clock and is automatically sounded as a musical sound, at the set volume level.

5 Claims, 11 Drawing Figures

| SCALE | 8 | 4 | 2 | 1 |
|---|---|---|---|---|
| C | 0 | 0 | 0 | 0 |
| C# | 0 | 0 | 0 | 1 |
| D | 0 | 0 | 1 | 0 |
| D# | 0 | 0 | 1 | 1 |
| E | 0 | 1 | 0 | 0 |
| F | 0 | 1 | 0 | 1 |
| F# | 0 | 1 | 1 | 0 |
| G | 0 | 1 | 1 | 1 |
| G# | 1 | 0 | 0 | 0 |
| A | 1 | 0 | 0 | 1 |
| A# | 1 | 0 | 1 | 0 |
| B | 1 | 0 | 1 | 1 |

| OCTAVE | 2 | 1 |
|---|---|---|
| 1ST. | 0 | 0 |
| 2ND. | 0 | 1 |
| 3RD. | 1 | 0 |
| 4TH. | 1 | 1 |

| NOTE | 16 | 8 | 4 | 2 | 1 |
|---|---|---|---|---|---|
| 𝅘𝅥𝅯 | 0 | 0 | 0 | 0 | 1 |
| 𝅘𝅥𝅮 | 0 | 0 | 0 | 1 | 0 |
| 𝅘𝅥 | 0 | 0 | 1 | 0 | 0 |
| 𝅗𝅥 | 0 | 1 | 0 | 0 | 0 |
| 𝅝 | 1 | 0 | 0 | 0 | 0 |

| | OCTAVE | | SCALE | | | | NOTE | | | | |
|---|---|---|---|---|---|---|---|---|---|---|---|
| (0 0 0 0) | 1 | 1 | 0 | 1 | 1 | 1 | 1 | 0 | 0 | 0 | 0 |
| (0 0 0 1) | 1 | 1 | 1 | 0 | 0 | 1 | 1 | 0 | 0 | 0 | 0 |
| (0 0 0 2) | 1 | 1 | 0 | 1 | 1 | 1 | 0 | 0 | 1 | 1 | 0 |

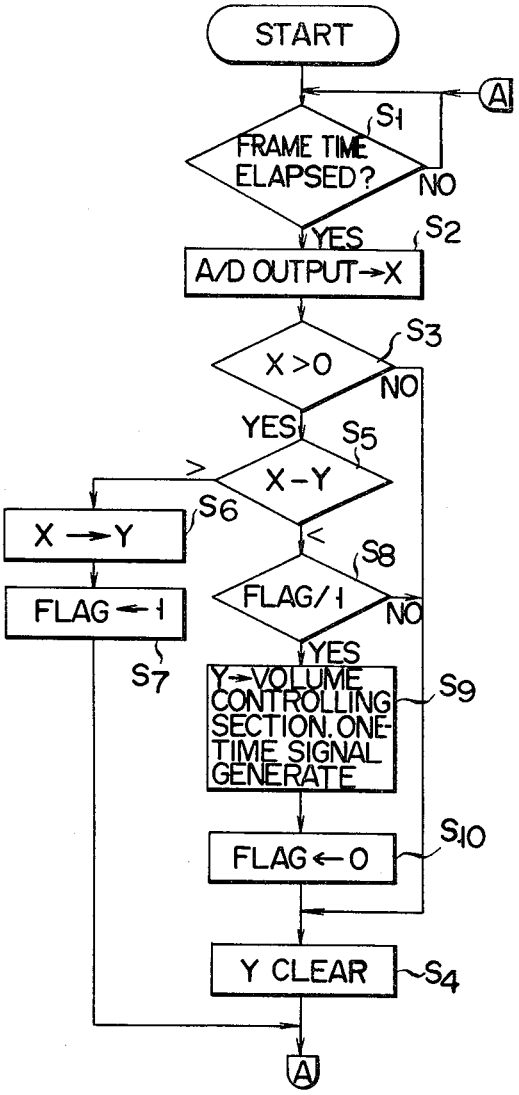
FIG. 9
FIG. 10
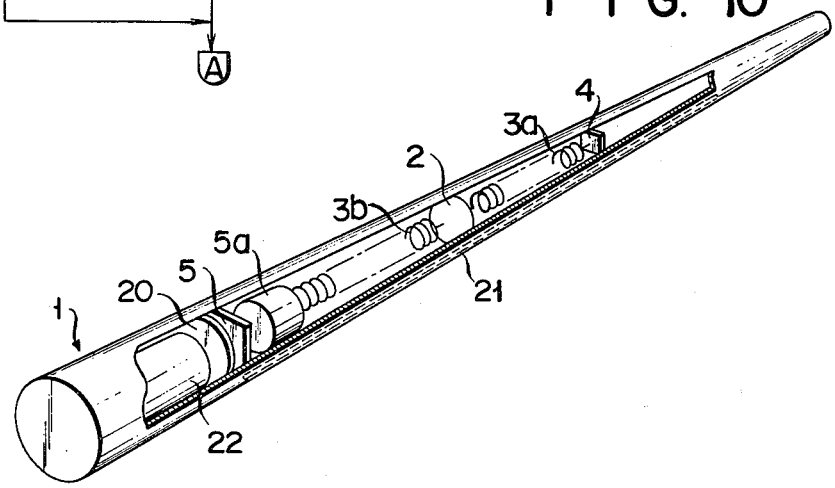

AUTOMATIC PERFORMING APPARATUS

BACKGROUND OF THE INVENTION

The present invention relates to an automatic performing apparatus for reading out tone data preset in a memory in accordance with a motion of a baton and applies the tone data to a tone generating section.

There has been an automatic performing apparatus in which tone data such as pitch data and sound-duration data are preset in sequence and, in the course of the performance, are read out in accordance with predetermined tempo clocks and a volume to produce a musical tone.

The musical tone produced from such an automatic performing apparatus is monotonous and not attractive. It is impossible to perform a musical piece with a deep emotion of a player. Therefore, the musical tone obtained is a mere emotionless tone.

Accordingly, an object of the present invention is to provide an automatic performing apparatus capable of performing a musical piece with a deep emotion of a player by reading out musical data preset in a memory in synchronism with a motion of a baton.

SUMMARY OF THE INVENTION

To achieve the above object, an automatic performing apparatus according to the present invention is comprised of: detecting means for detecting an amount of change in a motion of a baton; clock signal generating means for generating tempo clock signals on the basis of the change amount of the baton detected by the detecting means; a memory for sequentially storing tone data; and tone generating means for generating a tone dependent on the tone data read out from the memory in accordance with the tempo clock signal.

With such a construction, the tone data is sequentially read out from the memory on the basis of a tempo in accordance with the baton motion, and a corresponding musical tone is generated. Therefore, the automatic performing apparatus enables a player to play a musical piece with his emotion to make an attractive performance.

BRIEF DESCRIPTION OF THE DRAWINGS

FIG. 9 is a flow chart for illustrating an operation of a CPU used in the apparatus shown in FIG. 2;

FIG. 10 is a schematic diagram of a baton used in a second embodiment of the present invention.

DETAILED DESCRIPTION

Figure 1:
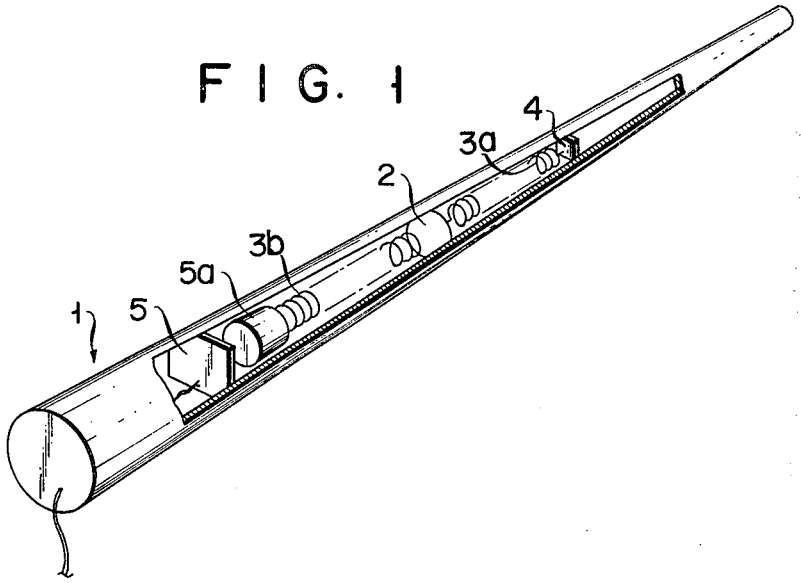
FIG. 1 is a schematic diagram of a baton which is used in a first embodiment of the present invention.
Figure 2:
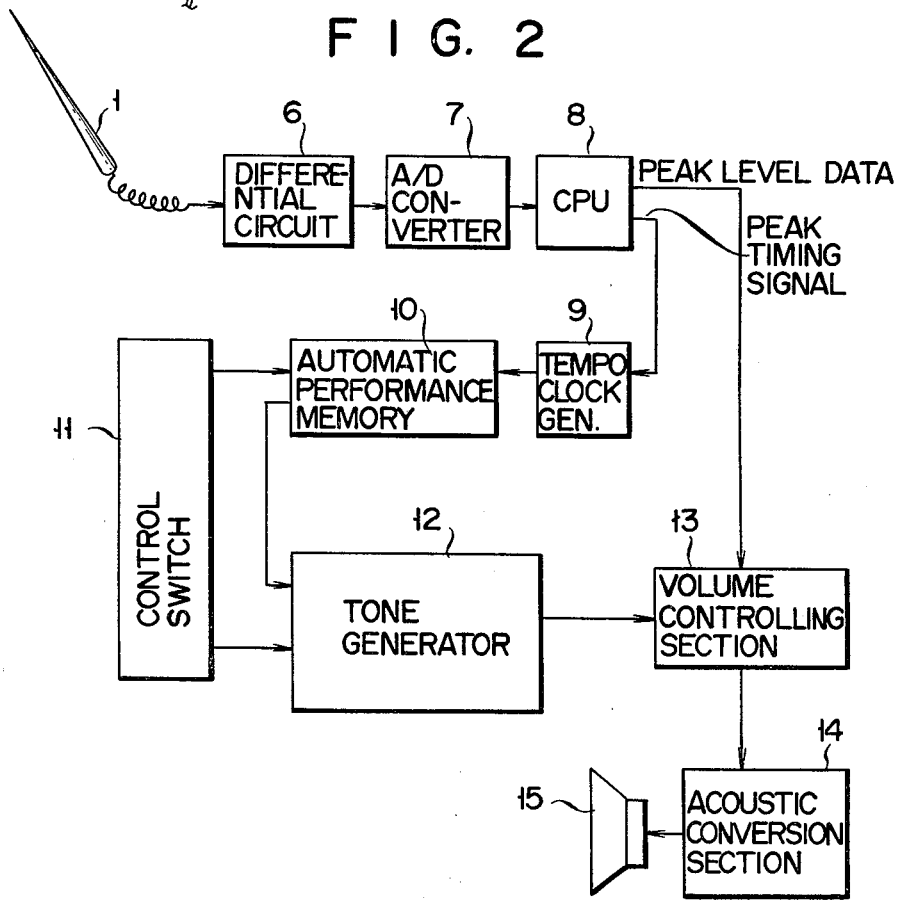
FIG. 2 is a block diagram of the first embodiment of an automatic performing apparatus according to the present invention.
Figures 3, 4:
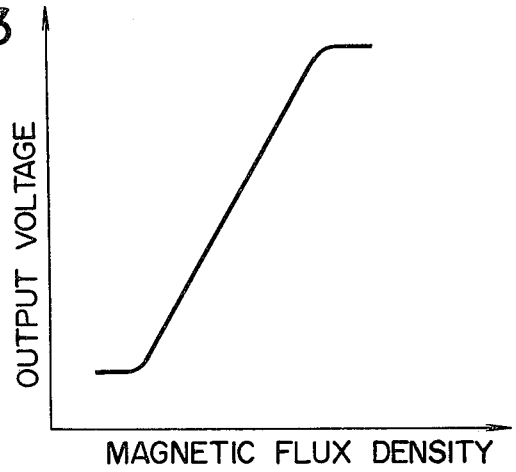
FIG. 3 is a diagrammatic representation of a relationship between magnetic flux density with respect to a baton motion and an output voltage of the baton shown in FIG. 1.
FIG. 4 is a code table tabulating scales stored in an automatic performance memory used in the apparatus shown in FIG. 2.

A first embodiment of the present invention will be described referring to the accompanying drawings. In FIGS. 1 and 2, a baton designated by reference numeral 1 has a weight ball 2 longitudinally movable therein with two coiled springs 3*a* and 3*b*; one end of the spring 3*a* fixed to a bracket 4 fixedly mounted in the baton 1 and one end of the spring 3*b* fixed to a magnet 5*a* disposed adjacent to a Hall element 5. When the ball 2 moves in the baton 1, the magnet 5*a* displaces to change a magnetic flux density and an output voltage of the Hall element 5, as shown in FIG. 3. In swinging the baton 1, great acceleration is applied to the baton 1 at the start and end of the baton swing. As a result, the ball 2 moves in the baton 1 and the output voltage of the Hall element 5 greatly changes every top of the baton swing. The output voltage is differentiated by a CR differentiating circuit 6 shown in FIG. 2 to be converted into a voltage corresponding to the acceleration of the baton 1. The voltage signal from the differentiating circuit 6 is applied to an A-D converter 7. The A-D converter 7 converts the voltage signal, which takes an analog form, into a digital signal which in turn is transferred to a central processing unit (CPU) 8 which may be a well-known microprocessor. The CPU 8 divides the digital output signal from the A-D converter 7 for each frame of 100 msec to several hundreds msec, and detects the timing at a peak level of the output signal in each frame and the absolute value and polarity of the output signal at the peak level. In the CPU, the absolute value of the peak level in the present frame is compared with that in the preceding frame. Only when the latter is larger than the former, the CPU 8 applies an output signal to the next stage. With respect to the signal representing the acceleration of the weight ball 2 in the baton 1, only the positive component of the signal is valid, while the negative component is invalid. This is well fitted for the manner of the performance and prevents chattering arising from the oscillations of the springs 3*a* and 3*b*. This will be described in detail later. The CPU 8 produces a signal representative of peak level data and a peak timing signal. The peak timing signal is applied to a tempo clock generator 9. The tempo clock generator 9 produces a tempo clock signal for transfer to an automatic performance memory 10 in which a desired musical piece is preset. The automatic performance memory 10 may be constructed by a RAM, for example. As will subsequently be described, tone data is set in the automatic performance memory 10. The motion of the baton 1 is performed on one-time base and the peak timing signal is also synchronized with it. The tempo clock generator 9 includes a control means which detects a tempo provided by preparatory motions of the baton and cause the automatic performing apparatus to initiate the performance, and a means which stores a period of the former one-time, predicts a period of the next one-time on the basis of the period of the former one-time, and forms fine clocks, such as one-quarter time and one-eight time, on the basis of the predicted tempo.

The automatic performance memory 10 subsequently supplies the stored data of a musical tone selected under control of a control switch 11 to a tone generator 12, in accordance with the tempo clock signal. In the tone generator 12, the musical piece data supplied is decoded into signals of a given pitch and given duration. The control switch 11 supplies various control data, for example, tone color data to the tone generator 12. A volume control section 13 receives a musical tone signal from the tone generator 12 and at the same time peak level data from the CPU 8. Therefore, data signal representing a change of volume is added to the tone signal, so that a volume-controlled signal is applied to an acoustic conversion section 14. The volume controlling section 13 may be a VCA (voltage controlled amplifier), for example. The acoustic conversion section 14 converts the digital signal applied into a corresponding analog signal, and applies the analog signal to a loudspeaker 15.

Figures 5, 6, 7, 8:
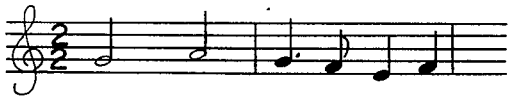
FIG. 5 is a code table tabulating octaves stored in the automatic performance memory in the apparatus shown in FIG. 2.
FIG. 6 is a code table tabulating notes stored in the automatic performance memory.
FIG. 7 is a score of a musical piece.
FIG. 8 illustrates the contents of the memory in which tones in the musical piece in FIG. 7 are coded and set.

The explanation of the tone data stored in the automatic performance memory 10 will be given. Tone data is set in the automatic performance memory 10 through the operation of the control switch 11. FIGS. 4 and 5 tabulate codes of pitches of the tone in such a case. FIG. 4 tabulates notes by 4-bit codes. A further wider compass may be designated by codes with larger number of bits.

In FIG. 6, notes are expressed by 5-bit codes. Dotted notes are expressed in accordance with the code table in FIG. 6; a dotted quarter note is "00110" and a dotted half note is "01100".

When the pitch code and the duration code are set up in this way, the musical piece as shown in FIG. 7, for example, is converted into code data as shown in FIG. 8 and stored in the automatic performance memory 10. The leftmost column of the table in FIG. 8 contains addresses in the automatic performance memory 15.

The code data representing pitch and duration of the tone may be expressed by other suitable formats. A chord may also be recorded in the automatic performance memory. In this case, codes representing kinds of the chord such as major, minor, 7th and the like may be combined with a code representing a root of the chord to provide one chord.

Further, rest note data, end data and repeat data may also be preset in the automatic performance memory 10.

In addition to the switch operation by the control switch 11, there are many other methods to set the musical tone data in the automatic performance memory 10. For example, the tone data may be set by means of input means such as a magnetic card, a ROM package, a bar code, and a paper tape.

The processing operation of the CPU 8 of the present embodiment will be described by referring to FIG. 9 illustrating an operation flow of the CPU 8. In a step $S_1$, a frame time is measured by a counter provided in the CPU 8. When count of the counter reaches a predetermined value, the operation of the CPU 8 advances to a step $S_2$.

In the step $S_2$, a digital output of the A-D converter 7 is set in an X register contained in the CPU 8. In the next step $S_3$, it is checked whether the contents of the X register are positive or negative. If the contents of the X register are negative, the CPU 8 judges it to be invalid and executes a step $S_4$ where a Y register to be described later is cleared. Then, it returns to the step $S_1$. On the other hand, if the contents of the X register is positive, the CPU 8 judges it to be valid since the acceleration of the baton 1 is positive, and advances to a step $S_5$.

In the step $S_5$, the contents of the Y register which are previously stored are compared with those of the X register. When the contents of the X register are larger than those of the Y register, the CPU 8 executes a step $S_6$ where the contents of the X register is transferred to the Y register. Then, it executes a step $S_7$ where "1" is loaded into a flag register and then returns to the step $S_1$.

In the step $S_5$, when the Y register has larger contents than the X register, the CPU 8 advances to a step $S_8$ where it is judged as to whether the flag register has "1" or not. If the result of the judgement is NO, the step $S_4$ is executed. Conversely, if the result is YES, a step $S_9$ is executed in which the contents of the Y register, i.e. a peak level, is transferred to a volume controlling section 18, while at the same time a peak timing signal (one-time signal) is formed and transferred to the tempo generator 9. Following this step, the CPU 8 executes a step $S_{10}$ to render the contents of the flag register 10 "0" and returns to the step $S_1$ after execution of the step $S_4$.

In this way, the output of the A-D converter 7 is compared, for each frame time, to the output data in the preceding frame time. At the instant that the maximum level is detected (actually, in the next frame), a one-time signal is obtained and by the maximum level, the volume controlling section is controlled to set a volume of the musical tone.

Figure 11:
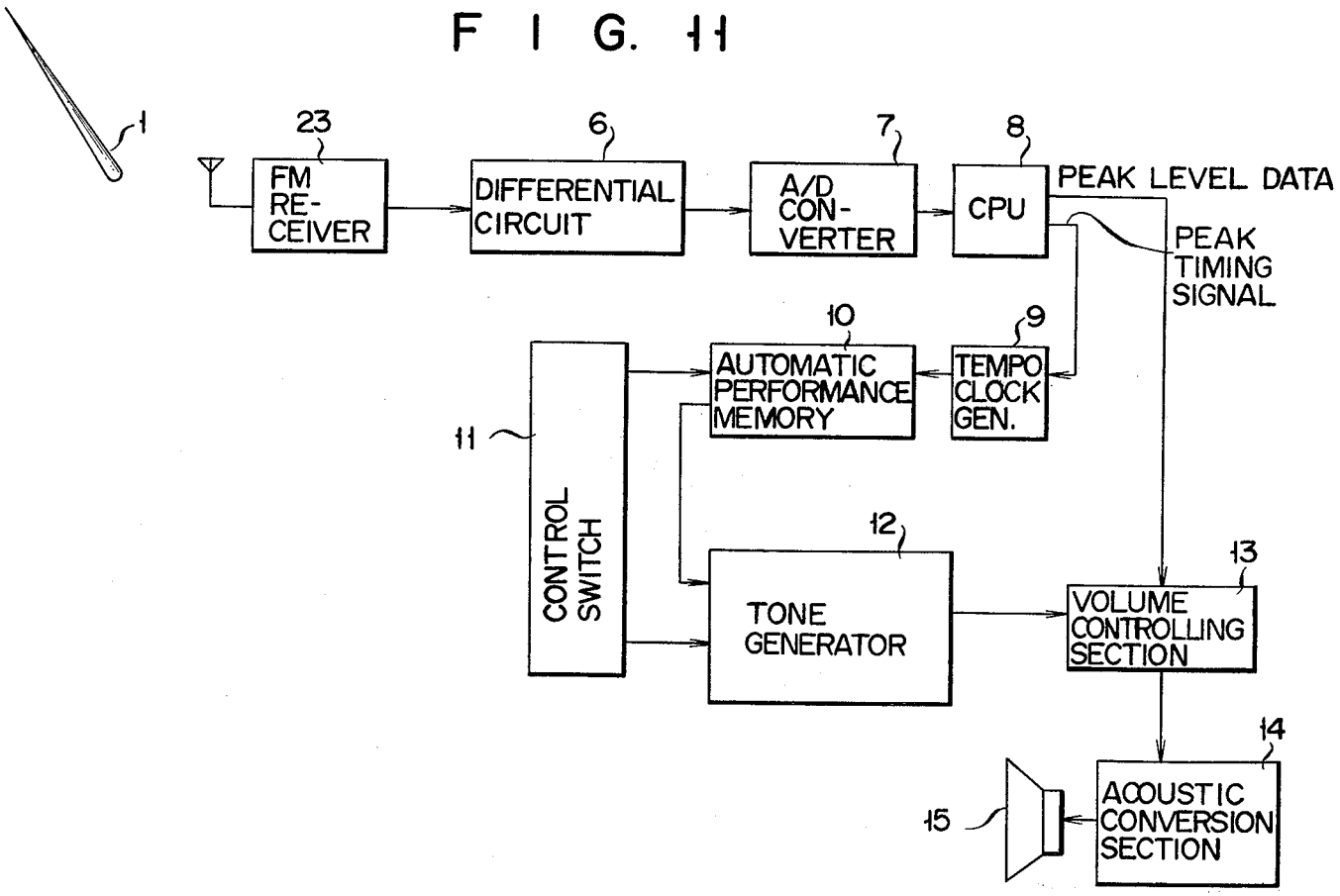
FIG. 11 is a block diagram of the second embodiment of an automatic performing apparatus according to the present invention.

A second embodiment of the present invention will be described by referring to FIGS. 10 and 11. The present embodiment is designed with the intention of improving an operability of the baton 1. In the figure, like reference numerals are used to designate like portions in the first embodiment, for simplicity of explanation.

In FIG. 10, reference numeral 20 designates a printed circuit board with an FM transmitter connected to an antenna 21. Reference numeral 22 designates a battery for supplying electric power to the FM transmitter. When the weight ball 2 moves in the baton 1, the Hall element 5 changes, as shown in FIG. 3, its output voltage due to a change of the flux density in accordance with a displacement of the magnet 5*a*. At the start and end of the swing of the baton 1, a great acceleration is applied to the baton 1, so that the ball 2 moves in the baton 1. The output voltage of the Hall element 5 greatly changes for each top of the baton swing. The output voltage is frequency modulated and transmitted from the antenna 21. An FM receiver 23 shown in FIG. 11 receives the signal transmitted from the baton 1. The output signal of the FM receiver 23, as in the case of the first embodiment, is applied to a differential circuit 6 and then to an A-D converter 7 where it is converted into a digital signal. The digital signal converted is supplied to the CPU 8. The CPU 8 forms the peak level data and the peak timing signal (or the one-time signal) to make an access to the automatic performance memory 10. In this way, a tone signal is produced in synchronism with the motion of the baton 1.

In the above-mentioned embodiment, the weight ball 2 and the magnet 5*a* movable relative to the ball 2 are used for the moving elements, the Hall element 5 is for the acceleration sensor and senses the acceleration in the form of the flux density change. Electrical field or mechanic to electric converter (load cell) may be used for the moving elements and the acceleration sensor.

While in the second embodiment, the FM transmitter provided in the baton 1 transmits a control signal to the FM receiver 23 provided separately from the baton 1, the method of transmitting the control signal is not limited to that of the second embodiment.

What is claimed is:

1. An automatic performing apparatus comprising detecting means for detecting an amount of change in a motion of a baton; clock signal generating means for generating tempo clock signals on the basis of the motion change amount of the baton detected by said detecting means; a memory for sequentially storing tone data; and tone generating means for generating a tone dependent on said tone data read out from said memory in accordance with said tempo clock signal.

2. An automatic performing apparatus according to claim 1, wherein said baton includes a moving element; and sensor means for detecting an amount of change in a motion of said moving element and delivering an electronic signal representing the detected amount of change in motion of said moving element.

3. An automatic performing apparatus according to claim 2, wherein said baton further includes a transmitter for transmitting an output signal from said sensor means, and an external receiver receives the transmitted signal from said transmitter to detect the change in the motion of said baton.

4. An automatic performing apparatus according to claim 1, wherein said detecting means detects volume level data on the basis of the change in the baton motion and includes means for transmitting the volume level data to a volume control means to effect a volume control.

5. An automatic performing apparatus according to claim 4, wherein said volume control means is a voltage controlled amplifier.

* * * * *